US010329869B2

(12) United States Patent
Kunz

(10) Patent No.: US 10,329,869 B2
(45) Date of Patent: Jun. 25, 2019

(54) WELL ABANDONMENT TOOL AND METHOD OF USE

(71) Applicant: WINTERHAWK WELL ABANDONMENT LTD., Calgary (CA)

(72) Inventor: Dale Kunz, Calgary (CA)

(73) Assignee: WINTERHAWK WELL ABANDONMENT LTD., Calgary (CA)

( * ) Notice: Subject to any disclaimer, the term of this patent is extended or adjusted under 35 U.S.C. 154(b) by 0 days.

(21) Appl. No.: 15/780,956

(22) PCT Filed: Dec. 5, 2016

(86) PCT No.: PCT/CA2016/051429
§ 371 (c)(1),
(2) Date: Jun. 1, 2018

(87) PCT Pub. No.: WO2017/091911
PCT Pub. Date: Jun. 8, 2017

(65) Prior Publication Data

US 2018/0363407 A1 Dec. 20, 2018

(30) Foreign Application Priority Data

Dec. 4, 2015 (CA) ..... 2913933

(51) Int. Cl.
*E21B 33/128* (2006.01)
*E21B 33/13* (2006.01)
(Continued)

(52) U.S. Cl.
CPC ..... *E21B 33/128* (2013.01); *E21B 33/1208* (2013.01); *E21B 33/129* (2013.01);
(Continued)

(58) Field of Classification Search
CPC .... E21B 33/128; E21B 33/1293; E21B 33/13; E21B 33/129; E21B 33/134; E21B 23/01;
(Continued)

(56) References Cited

U.S. PATENT DOCUMENTS 3,068,942 A 12/1962 Brown
3,464,709 A 9/1969 Furgason et al.
(Continued)

FOREIGN PATENT DOCUMENTS

CA 2759158 8/2007

OTHER PUBLICATIONS

International Search Report received in corresponding PCT Application No. PCT/CA2016/051429, dated Feb. 17, 2017, 3 pages.
(Continued)

*Primary Examiner* — Zakiya W Bates
(74) *Attorney, Agent, or Firm* — Parlee McLaws LLP; Sean Goodwin

(57) ABSTRACT

A tool is provided for use in closing and sealing the cased bore of a well to be abandoned. The tool is run into the bore, the tool having a stack of pleated rings slidably mounted on a tubular mandrel. The tool is engaged with the casing and a charge of hot asphaltic sealant is discharged from a conveyed container to flood the stack and tool annulus. The stack is compressed axially to partly flatten and radially expand the rings to frictionally engage the surrounding casing, the rings and sealant sealing the bore. Further, the rings can expand the heated casing for sealing casing/cement interfaces. The sealant solidifies and creates an impermeable mass sealing against surfaces of the mandrel, stack and casing.

25 Claims, 12 Drawing Sheets

(51) Int. Cl.

| | |
|---|---|
| ***E21B 33/134*** | (2006.01) |
| ***E21B 33/12*** | (2006.01) |
| ***E21B 33/129*** | (2006.01) |
| ***E21B 34/10*** | (2006.01) |
| *E21B 34/00* | (2006.01) |

(52) U.S. Cl.
CPC ..... *E21B 33/1293* (2013.01); *E21B 33/13* (2013.01); *E21B 33/134* (2013.01); *E21B 34/10* (2013.01); *E21B 2034/005* (2013.01)

(58) Field of Classification Search
CPC ..... E21B 33/1208; E21B 33/1216; E21B 33/1291
See application file for complete search history.

(56) References Cited

U.S. PATENT DOCUMENTS

| | | | | |
|---|---|---|---|---|
| 4,116,451 | A * | 9/1978 | Nixon | E21B 4/003 277/336 |
| 4,127,168 | A * | 11/1978 | Hanson | E21B 23/02 166/123 |
| 4,444,400 | A | 4/1984 | Norman | |
| 6,581,682 | B1 | 6/2003 | Parent et al. | |
| 2015/0285026 | A1 * | 10/2015 | Frazier | E21B 33/1291 166/120 |

OTHER PUBLICATIONS

Written Opinion received in corresponding PCT Application No. PCT/CA2016/051429, dated Feb. 17, 2017, 3 pages.

* cited by examiner

WELL ABANDONMENT TOOL AND METHOD OF USE

CROSS-REFERENCE TO RELATED APPLICATIONS

This application claims priority to Canadian Patent Application No. 2,913,933 filed Dec. 4, 2015, the entirety of which is incorporated herein by reference.

FIELD

The present disclosure is directed to a tool and method of using the tool useful for plugging wellbores. They particularly find application in the procedure practiced in abandoning the cased bore of a well.

BACKGROUND

Oil and gas reservoirs are accessed with a well casing extending downhole to a subterranean formation, and traversing various strata therealong. In the completion process, an annulus is formed between the casing and the formation. The annulus is filled with cement to seal the annulus, blocking cross-strata fluid communication and communication to surface. At the end of the commercial life of the well the well is abandoned.

The Alberta Energy Regulator currently requires that a "bridge plug" be installed as the first step in well abandonment. The bridge plug comprises a mechanical tool having a body carrying slips to grip the casing and an expandable, elastomeric seal ring to seal against the casing's inner surface. The tool can be operated by a tubing string extending down from surface. The body and seal ring thereby combine to permanently close and seal the cased bore.

During a conventional abandonment procedure the bridge plug is positioned and set at a pre-determined depth in the bore of the casing. A hydraulic pressure test is then carried out to determine if the bridge plug and casing are competent to hold pressure. The pressure test is currently performed by filling the casing bore with water and applying pressure at 1000 psi for 10 minutes. After it has been determined that both the bridge plug and the casing above the bridge plug are competent, a column of cement (typically 25 feet in length) is deposited in the bore immediately above the bridge plug. Finally, the top end of the steel casing is cut off at a point below ground level and a steel plate or vented cap is welded on the upper end of the casing.

However, problems can commonly arise over time with this system for plugging and abandoning wells. For example, the elastomeric element of the bridge plug may develop surface cracks or otherwise deteriorate and allow fluid to leak thereby.

Further, in the instance where the casing-to-cement and cement-to-formation seal fails, unacceptable hydrocarbon flow can occur to surface. Minute cracks may also develop in the cement column, including shrinkage of the cement sheath around the outside of the casing forming a micro-annulus where the cement abuts the inside surface of the casing. One or more of these defects can result in natural gas or other fluid leaking either up through the cased bore or along the outside surface of the casing to surface. Such leakage indicates that the abandonment process has failed. This failure is commonly identified when vegetation surrounding the well at ground surface begins to die from hydrocarbon exposure.

Presently there are thousands of wells in Alberta that have been abandoned. Many have been identified as leaking fluid to ground surface. Therefore, there is a need in the industry for an abandonment tool and method for closing and sealing wells which addresses the limitations of the current methods.

SUMMARY

A well abandonment tool is provided for emplacement using a tubular string of pipe lowered into the casing bore of a well. The tool functions to permanently block and seal the bore on its own, or in combination above other known forms of casing plugs.

In one embodiment, a tool is located in the well casing forming a tool annulus thereabout, affixed to the casing at a sealing location, and the tool annulus is flooded with hot asphalt which seals the tool to the casing bore and blocks the passage of fluids thereby. In an embodiment, the tool blocks the casing uphole of the tool from the uphole passage of fluids, such hydrocarbons emanating from downhole of the tool.

In another embodiment, the tool further acts to expand the casing for closing any local presence of a micro annulus between the outside the casing and structure outside the casing. Typically the structure outside the casing is the formation or cement in the casing annulus. Accordingly, both the inside and the outside of the casing can be sealed for remediation of the well abandonment.

In one aspect, a tool is located in the bore of the casing and forming a tool annulus between the tool and the casing. The tool has an axial stack of annular pleated rings slidably mounted about a mandrel. Pleated rings have an outer diameter less than that in their less or unpleated state. An example of an unpleated ring is a flat washer. The stack of pleated rings is axially compressible on the mandrel. Within the stack, pleated rings flatten, expanding radially to engage the casing and impart an expanding hoop stress thereinto for local expansion of the casing. The stack of pleated rings is sandwiched between a stop or first slip that can be fixed axially and a second stop that can be moved towards the first slip. As disclosed, the tool has a first slip for anchoring one axial extent of the pleated rings. The mandrel, fit with the second stop, is manipulated to actuate the pleated rings against the first slip, compressing the rings. Once the desired radial expansion of the rings is achieved, a second slip is set to lock the stack of pleated rings in compression for securing the tool in the casing.

In an embodiment, each pleated ring is an annular ring that undulates about its circumference between peaks and valleys. Like a wave spring, each ring elastically resists axial force. When compressed axially to reduce its height, each spring expands radially, increasing its diameter. For predictability and uniformity of ring compression along the stack, one or more rings can be separated from one another by a flat washer. The peaks and valleys engage the flat washer during compression.

When the axial stack is actuated for compression from one end, the individual rings can vary in spring constant or like-rings along the stack are supplemented with variable concentrations of compressible pleat spacers distributed about the ring circumference. Higher concentrations of spacers are provided adjacent the actuation end of the stack to manage compression therealong. Copper tubing is suitable as are elastomeric rods such as those of nitrile.

In another aspect, while the tool is mechanically coupled to the casing, tool can further sealed to the casing with sealant distributed at the tool for sealing between the tool and the casing. A flow of fluid elastomer can be delivered to the bore and tool annulus for providing a permanent and reliable seal at the tool location. In an embodiment, a sealant is a heated, flowable asphalt.

In one embodiment, the mandrel has a through passage or tool bore for delivery of the sealant to the casing bore below the tool. Blocked from flowing downhole, sealant flows back uphole into the tool annulus. A pre-determined measured volume or charge is conveyed in a container with the tool downhole for deployment one the tool is located in the casing. The container can be a cylinder having storage area for the sealant charge within. Hydraulic actuation of a piston in the cylinder enables the storage area to be discharged from the tool.

In an embodiment, the pre-determined measured volume or charge of sealant is conveyed in a heated state. In the instance of asphalt or like sealant that is flowable when heated, the charge is stored in an insulated container, filled hot at surface and remaining hot enough during conveyance and operation to flow when needed. The insulated container is fluidly connected to the mandrel and supplies the charge of hot liquid sealant through bore of the mandrel. The mandrel is fluidly connected to the bore of the casing.

In another aspect, a method of abandoning a well is provided for sealing the casing bore of said well. A tool as described above is conveyed downhole into the bore of the casing on a tubing string. The tool is run-in-hole to a strategic blocking location in the casing for isolating the surface uphole thereof from well fluids downhole thereof. The tool is anchored in the casing such as with a first slip. The charge of sealant is released to flow out of the mandrel and about the stack of pleated rings in their uncompressed stage. The mandrel is actuated to compress the sealant-imbued rings and expand into the casing, displacing and distributing sealant about the compressed rings and along at least a portion of the axial extent of the tool. The ring compression is locked in, such as with a second slip, to permanently retain the rings in the axially compressed and radially expanded condition. The tubing string is separated from the tool, leaving the tool downhole to seal the bore of the casing. In an embodiment, the sealant is fluid when heated and solidifies at well temperatures. Accordingly, the sealant is conveyed and released hot, and when cooled to well temperatures, the sealant solidifies about the tool to seal the bore of the casing.

In one embodiment, an abandonment tool is provided having a central tubular mandrel having a longitudinal bore and connected to a conveyance string from surface. A stack of pleated rings is slidably mounted on the mandrel and sandwiched between first and second radially expandable locking assemblies such as slips. The first locking assembly is slidably mounted on the mandrel and releasably secured thereto. A first compression plate is slidably mounted on the mandrel between the first locking assembly and a first end of the stack. The second locking assembly is mounted to the mandrel at the other or second end of the mandrel. A second compression plate is mounted on the mandrel between the second locking assembly and the other end of the stack. The first locking assembly is actuable for locking engagement of first end of the stack to the casing. The mandrel and second locking assembly are axially actuable to compress the second end stack towards the first end. In an embodiment, the second locking assembly and second compression plate move axially as a compression unit with the mandrel when pulled by the pipe string to compress the stack.

Upon the stack reaching the design compression, the second locking assembly actuates into locking engagement with the casing to axially lock the compression in the stack of rings. One or both of the locking assemblies can be slips. In an embodiment, frangible means such as shear pins are provided to release one or more of the slips into locking engagement with the casing. The first slip can be released such as at a first force when the tool is located at the sealing location. The second slip can be released at a second force when the stack has been compressed to seal the bore. Release force, for separating the conveyance tubing string from the tool, can be applied by applying a torque or a pulling force to the mandrel.

In a further embodiment, the bore of the mandrel is fit with container of sealant. A one way valve is fit to the mandrel bore at a downhole end and, when opened, is fluid communication with bore of the casing below the tool. The tool can also be equipped with a casing plug downhole of the one way valve so as to block or limited the extent of sealant flow downhole thereof and to urge sealant uphole about the stack of rings. In another embodiment, an independent casing plug, such as previously placed bridge plug or older failed plug, can be utilized in combination with the tool, being located downhole of the tool prior to running in of the tool. The casing plug blocks sealant flow downhole of the tool.

The tool can be run in and positioned downhole and is actuated by means such as the tubular pipe string extending from a rig at ground surface.

The locking assemblies can be slip assemblies for locking the stack to the casing. The first slip assembly is actuated by rotation of the mandrel to axially drive a cone ramp surface radially inward of circumferentially spaced first slips to drive the slips radially outwardly and to the casing. The first slips can be supported on a collet and held axially by drag blocks. The second slip assembly is actuated by axial movement of the mandrel. The axial actuation of the mandrel can axially drive a cone ramp surface radially inward of circumferentially spaced second slips to drive the slips radially outwardly and to the casing.

Therefore the slip assemblies can be selectively actuated at separate stages of the emplacement. Typically the first slip assembly and first compression plate are located at the upper end of the ring stack and the second compression plate and second slip assembly are located at the lower end. Therefore the first slip assembly can initially be expanded by mandrel rotation, overcoming first shear pins in the cone, to lock the upper end of the stack in place. Subsequently the mandrel can be pulled upwardly to cause the lower compression plate to compress the stack against the fixed upper compression plate. These steps are performed by manipulating the pipe string which is connected with the mandrel. The second slip assembly is locked, such as by second shear pins to the mandrel, and remains non-expanding through most of the compression step until the extent of axial pull on the mandrel causes the second shear pins to release so as to allow the cone to engage the second slip to expand and engage the casing.

The container assembly preferably comprises a thermally insulated container having a chamber containing a piston at its upper end and closed at its bottom end by a frangible disc. The container is connected between the pipe string and the mandrel. Fluid pressure applied through the bore of the pipe string is used to bias the piston downwardly, pressurizing the container and rupturing the disc to discharge the contained charge of hot liquid sealant from the chamber through the bore of the mandrel. The sealant preferably is asphaltic in nature. It melts when heated sufficiently and solidifies when it cools to seal against surfaces with which it is in contact. The mandrel and rings are normally formed of steel. Preferably, flat washers are provided between the pleated rings.

In another aspect, in use, the tool as described above can be run in hole to the sealing location and operated for releasing and expanding the first locking assembly to engage the casing and thereby positionally fix the first compression plate and the upper end of the stack. The container assembly is activated to discharge a charge of hot liquid sealant through the mandrel bore, filling the stack and the annular space between the stack and the casing with hot sealant. Further, heat is thereby transferred from the sealant to the adjacent surrounding casing. The mandrel is actuated to pull the mandrel and bottom compression unit upwardly so that the stack is compressed against the fixed upper compression plate, flattening the pleated rings to expand radially to engage the adjacent heated casing section, expanding the casing into the casing annulus. One continues to pull the mandrel until the second locking assembly is released and expanded to engage the casing and thereby positionally fix the lower end of the stack. Thereafter, the pipe string is disengaged and removing from the well. The sealant cools and solidifies into an impermeable mass having sealing engagement with surfaces of the rings, mandrel and casing.

In another embodiment, the sealing location for the tool can be aligned with existing perforations in the casing, perforations can be created, or the casing can be cut about all or a portion of its girth to access the casing annulus thereout. Accordingly, when the tool is actuated, the sealant is not only discharged about the tool annulus, but is also discharged through the access ports formed in the casing and into the casing annulus. As the casing annulus is typically cement, the remediation of the cement is two-fold: by mechanical expansion of the casing itself, and sealant flowing into and along any defects in the cement.

From the foregoing it will be observed that the present system involves the following actions and potential results. One contacts the tool with an adjacent section of steel casing with hot liquid sealant which causes the casing wall to thermally expand radially a small amount and makes the casing more pliable and receptive to expansion. Axial compression of the stack radially expands the pleated steel rings to press against the heated casing wall, interlock with it and effect a metal-to-metal circumferential engagement with it. The tool frictionally engages the casing with the top and bottom slips to thereby permanently maintain the stack in a compressed and expanded condition. The expanded stack can sufficient expand the casing that provides closure of micro-annular spaces in the casing annulus to block fluid communication therealong. The tool forms an impermeable mass of cooled and solidified sealant that provides closure of the casing bore and seals against the surfaces of the stack, the mandrel, and the inner surface of the casing. The radial compression is significant and should a cement annulus shrink over time, the rings continue to can continue to expand the casing to close any micro annulus that could otherwise form.

The system is characterized by the following attributes: the steel rings and the asphaltic sealant combine to formulate a plug that is highly resistive to shrinkage, cracking and degradation in the downhole environment and therefore may better resist failure over time when compared to cement and elastomer; the rings, washers and mandrel combine to form a frame or skeleton that reinforces and stabilizes the mass of sealant; the dual effects of heating and radial force application applied to the casing wall section opposite to the tool tend to radially expand the casing wall a small amount, which may result in closing cracks in the surrounding exterior casing sheath and thereby potentially lead to reduction or elimination of substantial fluid leakage up the well annulus; and the stack of pleated rings, locked in a compressed expanded state, should continue to indefinitely interlock with and press against the surrounding casing wall, thereby maintaining the wall in an expanded condition.

In an independent aspect of the invention, a component assembly is provided having a stack of pleated steel rings, separated or bracketed by flat annular washers, which is slidably mounted on a mandrel between flat compression plates. The washers serve to distribute compressive force evenly to the pleated rings and cause diametral expansion thereon. The rings are dimensioned and configured so that they are insertable in the casing bore and yet, when compressed a suitable amount (e.g. 50% of their axial pleat height), they are operative to expand radially sufficiently to press against the casing wall and provide a circumferential frictional interlock or engagement with the casing.

In a further preferred feature, compression-modifying or resistant spacers may be positioned in varying density amongst the pleats and between the washers, so as to provide a characteristic of increasing resistance to compression of the individual pleated rings from the fixed compression plate to the actuated compression plate. Thus the pleated rings that are sliding along the mandrel and relative to the casing, from the actuated compression plate towards the fixed compression plate, are the last to be compressed. The pleated rings therefore expand in sequence to control the drag of the expanding rings as they are axially compressed.

In summary, the fully operational or complete well abandonment tool is characterized by capabilities for effecting: the application of metal-to-metal circumferential radial force and frictional engagement of the rings with the well casing; heating of the casing wall at the point of radial force application; and fluid tight closure and sealing of stack, mandrel and internal casing section surfaces.

In still another aspect the invention comprises the previously described method for establishing a plug downhole in the course of well abandonment.

In still another aspect the invention comprises a product or plug which closes and seals the bore of a string of casing in a well. The plug comprises a steel skeleton supporting a mass of asphaltic sealant. It is positioned downhole to prevent upward migration of fluid through the casing bore. The plug comprises a central mandrel; a stack of axially compressed pleated rings mounted on the mandrel and circumferentially and frictionally engaging the casing; expanded locking assemblies connected with the mandrel and located at top and bottom of the stack, said locking assemblies frictionally engaging the casing so as to be positionally fixed to thereby maintain the pleated rings in the compressed condition; and a mass of impermeable solidified asphaltic material sealing against surfaces of the mandrel, stack and casing and providing closure of the casing bore.

BRIEF DESCRIPTION OF THE FIGURES

FIG. 6A illustrates the tool and conveyance string of pipe run in hole to the sealing location;

FIG. 6B illustrates actuation of the uphole slip;

FIG. 6C illustrates discharge of the sealant;

FIG. 6D illustrates compression of the stack of rings to seal the casing.

FIG. 6E illustrates actuation of the downhole slip;

FIG. 6F illustrates separation of the pipe string between the sealant container and the engaged stack of rings;

FIG. 6G illustrates the sealed tool in the well;

FIG. 8B illustrates the stack of pleated rings in run in mode;

FIG. 9A illustrates the stack of rings with the first slip actuated to engage the casing, the casing not shown;

FIG. 9B illustrates the stack of rings with the mandrel actuated to compress the stack;

FIG. 9C illustrates the stack of rings with the second slip set to locing in the compression and fix the tool to the casing;

FIG. 11A illustrates a first conveyance string and abrasive tool, at the sealing location, for cutting perforations in the casing or cutting the entire girth of the casing;

FIG. 11B illustrates the casing cut at the sealing location and the abrasive tool pulled out of hole;

FIG. 11C illustrates the abandonment tool and conveyance string of pipe run in hole to the cut casing at the sealing location;

FIG. 11D illustrates actuation of the uphole slip;

FIG. 11E illustrates discharge of the sealant; and

FIG. 11F illustrates compression of the stack of rings to seal the casing and actuation of the downhole slip.

DESCRIPTION OF PREFERRED EMBODIMENTS

Figure 1:
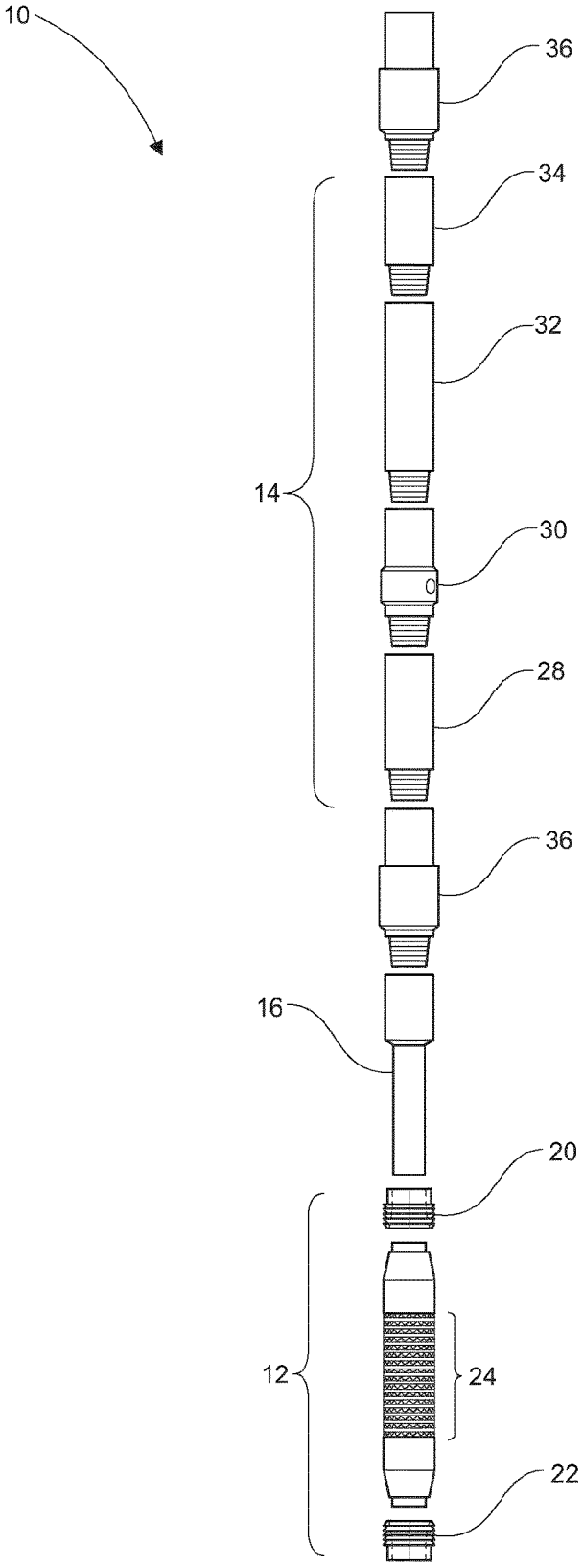
FIG. 1 is a side view of an embodiment of the abandonment tool with its components broken apart.

Having reference to FIG. 1, an embodiment of a well abandonment tool 10 is provided for conveyance downhole into the cased bore of a well. The tool generally comprises a downhole tool 12 for positioning and abandonment downhole, a container assembly 14 for conveying sealant downhole, and a separation sub 16 or snap latch connector for separation of the container assembly from the tool 12. The tool itself has upper and lower slips, 20, 22 and a stack of pleated rings 24. The container assembly 14 has a separation sub, a rupture disc sub 28, a sealant filling sub 30, a sealant chamber 32, a piston sub 34. A quick connecter 36 couple the container assembly 14 to a string of conveyance tubing or pipe.

Figure 2A:
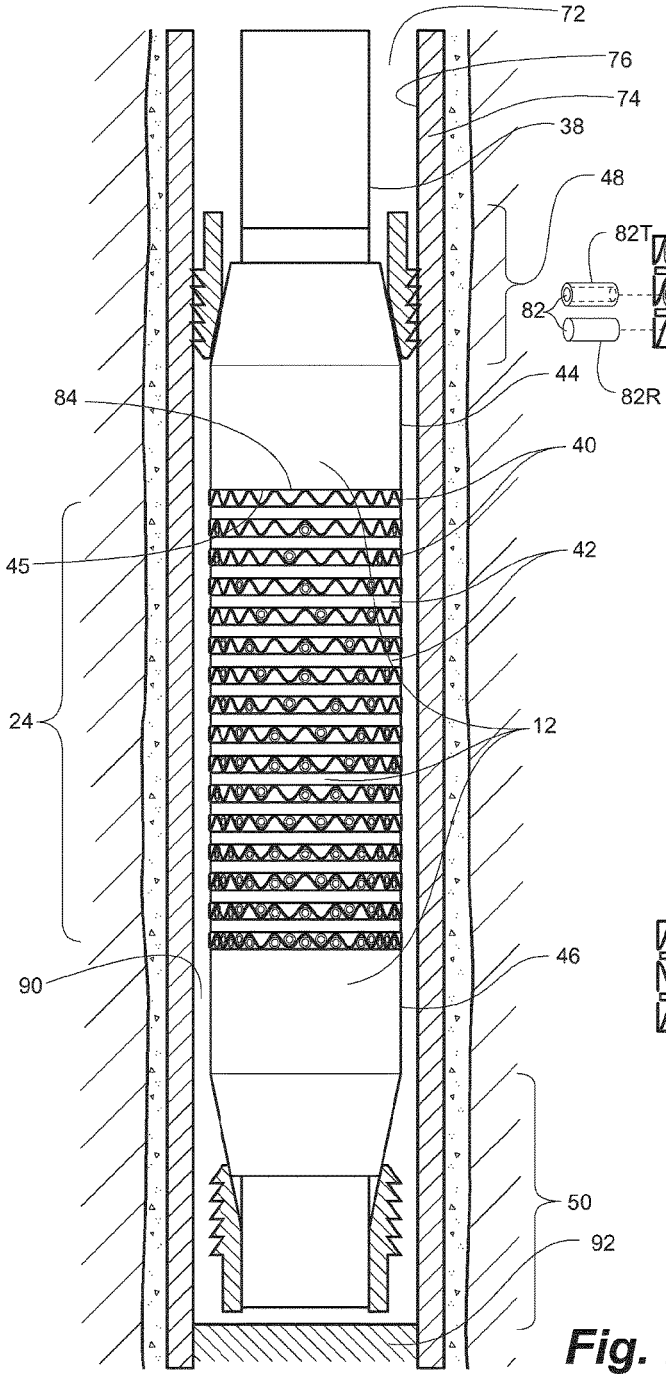
FIG. 2A is a side view of the tool in a cross-section of casing, the stack of pleated rings having an increasing density of compression modifiers closer to the actuating end of the stack.

Having reference to FIG. 2A, the downhole tool 12 comprises a central tubular mandrel 38. The mandrel 38 serves to convey, downhole and to support, the stack 24 of pleated metal rings 40. The pleated rings 40 are formed of rings having an inner and an outer diameter. The rings 40 are crimped along radials to undulate up and down about the rings circumference. The inner diameter of each ring 40 is slidable on the mandrel 38. The pleated rings 40 are separated apart by flat, annular rings or washers 42. First and second compression plates 44, 46 bracket the stack 24 at its upper and lower ends respectively. The compression plates 44, 46 are axial stops that extend annularly about the mandrel 38 and engage the stack 24 of pleated rings at their opposing ends.

A first or upper slip assembly 48 is supported by the mandrel 38 above the upper compression plate 44. In this embodiment, the upper compression plate 44 becomes fixed axially when actuated, such as supported by the mandrel 38 or the upper slip assembly 48. The lower compression plate 46, washers 42 and stock 24 of pleated rings 40 are slidably mounted on the mandrel 38.

A second or lower slip assembly 50 is disengagably secured to the mandrel 38 below the lower compression plate 46. The lower compression plate is slidable upwardly along the mandrel to engage downhole end 45 of the stop and compress the pleated stack 24 against the upper compression plate 44. The lower slip assembly 50 can be disengaged from the mandrel 38 to axially fix the lower compression 46 plate as described in greater detail later.

Figure 3:
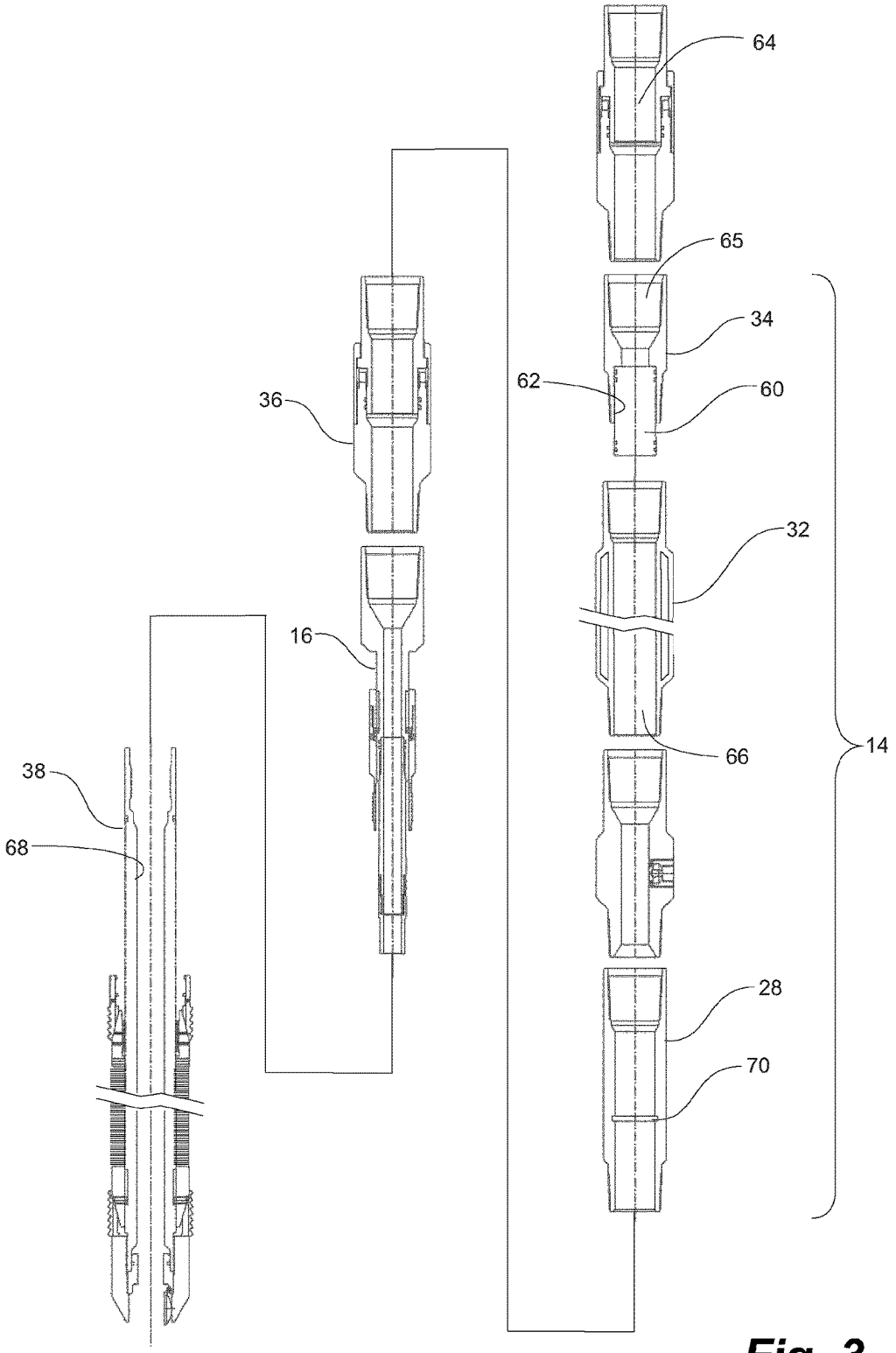
FIG. 3 is an exploded and cross-sectional side view of the tool, a sealant container and uphole pipe separation components.
Figure 4:
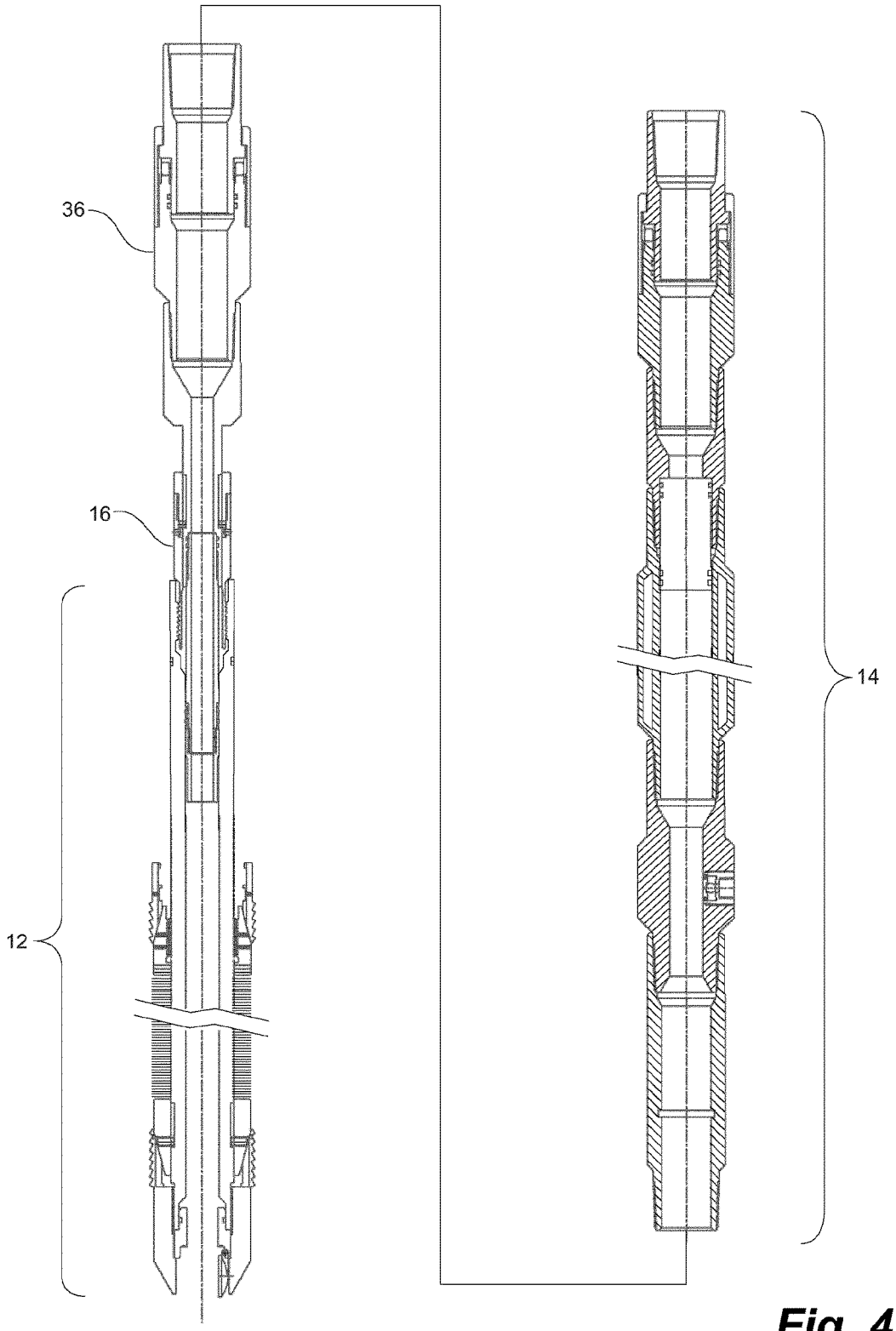
FIG. 4 is a cross-sectional assembled view of the conveyed tool according to FIG. 3.

With reference to FIG. 3, the abandonment tool 10 further includes the container assembly 14 fluidly connected to the mandrel 38.

The chamber 32 is actuated by a piston 60 initially housed in piston sub 34. The bore 62 of the piston sub 34 is in fluid communication with the bore 64 of conveyance tubing string of pipe through inlet 65 at its upper end. The conveyance tubing string of pipe extends uphole to ground surface for administration of fluid and fluid pressure control to actuate the piston 60. Chamber 32 has a bottom outlet 66 which communicates with the bore 68 of the mandrel 38. The chamber outlet 66 is initially closed by the rupture disc sub 28 at a frangible disc 22. A threshold pressure applied to the piston 60, pressurizes the sealant and ruptures the rupture disc 70 to flow sealant to the mandrel 38.

Figure 5A:
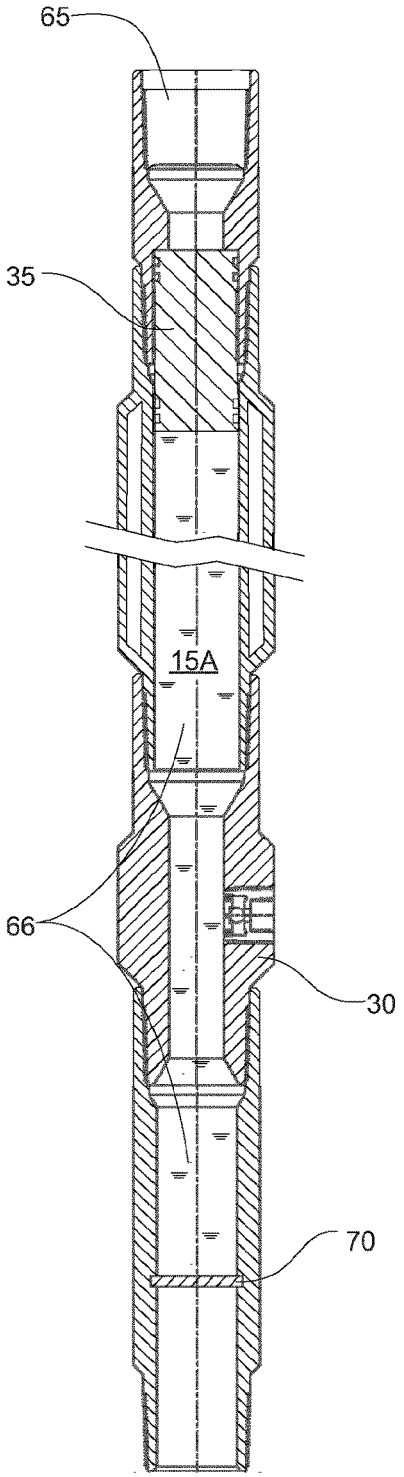
FIG. 5A is a cross-sectional view of the sealant container, filled with sealant and with frangible disc intact.

As shown in FIG. 5A, for filling the chamber, and located between the frangible disc and the piston, is a filling sub, having a one way valve for filling or refilling the chamber. Typically, the piston is initially lowered (such has shown in the emptied position in FIG. 5B) or fluidly driven to its lowest position, physically stopped against the filling sub. Accordingly, sealant can be injected under pressure into the chamber, displacing the piston upwardly to stop against the upper end of the chamber. Alternately, the filling port can be connected to a passive reservoir of sealant and the piston physically pulled up to draw sealant into the chamber. The piston can be equipped with an eyebolt connection or other connector for this purpose.

The mandrel 38 is formed of steel suitable for downhole use and is adapted for coupling at, at least, its upper end for connection to the container assembly 14. Referring to FIG. 2A, the pleated rings 40 are formed of corrosion—resistant material, such as stainless steel. Each pleated ring 40 is sized for a sliding fit on the mandrel 38 and are dimensioned and configured so that they are insertable in bore 72 the casing 74 in their normal, pleated condition but, when compressed axially, for example partly compressed to about ½ of their axial height, they are capable of extending out radially sufficiently so as to reach the inside surface 76 of the bore 72 and to press firmly against it, thereby frictionally engaging it and slightly expanding the wall casing 74.

Figure 2B:
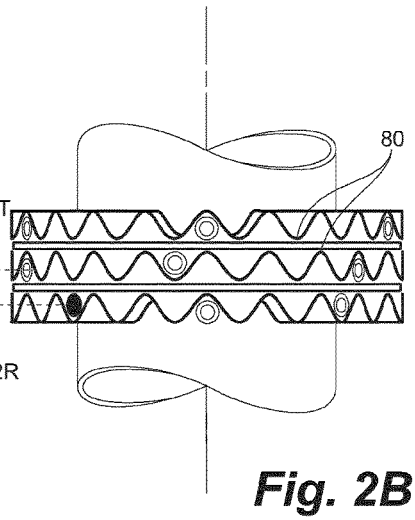
FIG. 2B is a close up view of adjacent pleated rings, the stack cut away above and below to illustrate the pleated rings separated by flat washers, having adjacent peaks and troughs misaligned, one spacer being illustrated in exploded view separate from the pleated rings, and a mandrel passing therethrough.
Figure 2C:
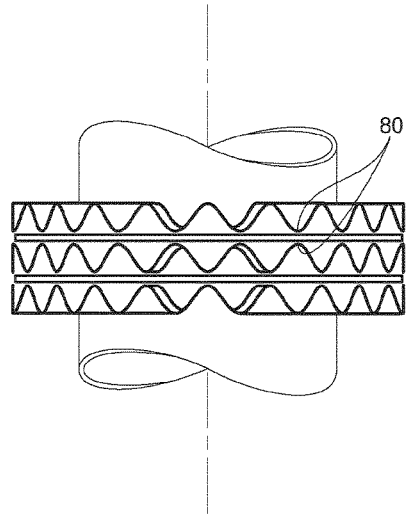
FIG. 2C is a close up view of adjacent pleated rings, according to FIG. 2B, with adjacent pleat peaks and troughs aligned.

With reference to FIGS. 2A and 2B, the stack 24 comprises flat annular washers 42 positioned between each adjacent pair of rings 40. The rings 40 can be oriented with their facing peaks 80 misaligned or aligned. As shown in FIG. 2B, if the peaks 80 of adjacent, facing pleated rings are misaligned, the intermediate flat washer is unsupported, and can be subject to deformation. As shown in FIG. 2C, if the peaks 80 of adjacent, facing pleated rings 40 are aligned, the intermediate flat washer 42 is supported between acting peaks and all the axially compressive force is transferred through the pleated rings. The flat washer can be a steel or an elastomeric including Durometer 90 nitrile rubber.

As shown in FIGS. 2A and 2B, the stack 24 further includes compression-modifying or resistant spacers 82 positioned between pleats and the flat washers 7. The spacers 82 are distributed in varying concentrations or density that diminishes upwardly from the lower compression plate 46 to the upper compression plate 44. The concentrations and distributions are selected so as to facilitate the desired sequential compression of the rings 40 from the stack's fixed end 84 downwards. The spacers 82 can be formed of short lengths of copper tubing 82T. The compression spacers 82 provide a characteristic of increasing resistance to compression of the individual pleated rings from the fixed compression plate to the actuated compression plate. Thus the pleated rings 40 that are sliding along the mandrel 38 and relative to the casing 74, from the actuated compression plate 46 towards the fixed compression plate 44, are the last to be compressed. The pleated rings 40 therefore expand in sequence to control the drag of the expanding rings as they are axially compressed.

Table 1 as follows sets forth relevant dimensional, material and compression data from a test in which a stack 24 of pleated rings 40, as shown in FIG. 2A was mounted on a mandrel 38 and axially compressed within a 60" length of oilfield 4.5" steel casing 74 using a press.

TABLE 1

| | |
|---|---|
| mandrel outside diameter-2.5" | Each ring pleat height-0.375" |
| casing inside diameter-3.826" | ring material-410 stainless steel |
| casing wall thickness-0.337" | ring wall thickness-0.025" |
| casing outside diameter-4.5" | Pleat spacers (copper tubing), 0.375" |
| number of pleated rings-10" | diameter and wall thickness-0.0625" |
| inside ring diameter-2.5" | flat steel washer thickness-0.125" |
| outside ring diameter prior to compression-3.750" | compressive force applied-~27,000 lb/ft |
| outside ring diameter (unconstrained) | extent of stack length reduction-about 40% |
| after compression-3.834" (Δ0.084") | Result: Casing expansion-about 0.008". |

Figure 5B:
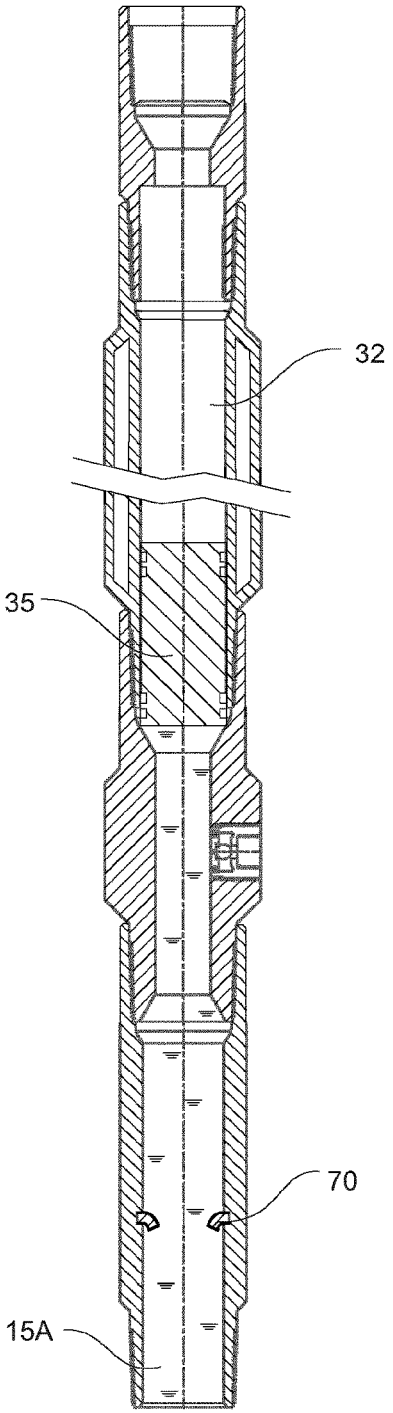
FIG. 5B is a cross-sectional view of the sealant container of FIG. 5A, after actuation with the frangible disc ruptured and the sealant discharged from the container.

With reference to FIGS. 5A and 5B, the container assembly 14 comprise a vacuum-insulated, double-walled tube having a chamber 32 within for storing sealant 15A. The chamber 32 contains the movable piston 35 at the upper inlet 65. The upper inlet 65 communicates with the bore of the tubing string. An upper end of the chamber 32 is closed by the piston 35. At its lower end of the assembly 14, the outlet is closed by a frangible shear disc 70. In an embodiment, the chamber 32 contains a charge of hot molten asphaltic sealant 15A. Plastomers are used to improve the high temperature properties of modified asphaltic materials. Low density polyethylene (LDPE) and ethylene vinyl acetate (EVA) are examples of plastomers used in asphalt modification.

The charge of sealant 15A, loaded into the container chamber 32, is a molten thermo-settable asphaltic liquid, typically heated to a temperature of about 200° C. A suitable sealant 15A is polymer-modified asphalt available from Husky Energy™ under the designation PG70-28. It melts at about 60° C. and solidifies at about 35° C. The hot asphaltic liquid can be filled at 200° C. and remain hot for up to about 8 hours, being available for discharge at about 190° C. Enough hot sealant can be stored on site for multiple wells.

The volumes of the container chamber 32 and the charge of sealant 15A are selected so as to enable filling of an annular space or annulus 90 between the tool 12 and the well casing 7A and an overage amount to accommodate excess volumes below the mandrel and above a casing plug 92.

Figures 6A, 6B, 6C, 6D:
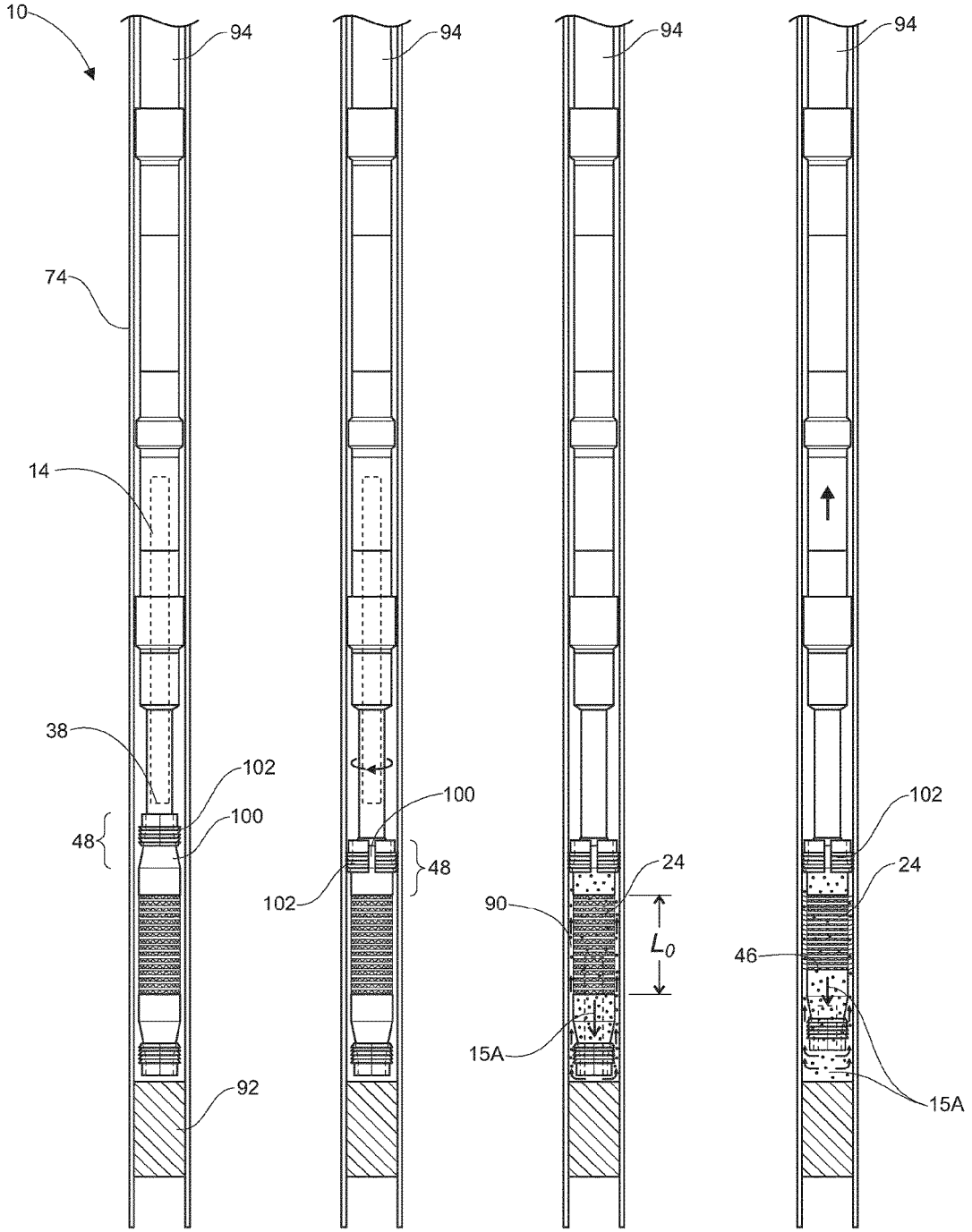
FIGS. 6A through 6G illustrate a cross-section of a well to be abandoned having a casing plug previously set therein and various steps of the deployment and operation of the tool above the casing plug, namely

With reference to FIGS. 6A through 6G, actuation of the abandonment tool 10 is carried out by manipulating the tubing string 94, the container assembly 14, and the mandrel 38 so that they together form a unit. As shown in FIG. 6A, the tool 10 is conveyed downhole to a sealing location, in this case above the casing plug 92. A conventional casing or bridge plug is already in place or set at depth and the casing above it is pressure tested to establish that the casing and the plug itself is competent.

In FIG. 6B, the tubing string 94 is rotated to shear frangible pins associated with the conventional upper slip assembly 48. An upper cone or expander 100 of the upper slip assembly 48 threadably ascends the mandrel 38 and biases the upper slips 102 into locking engagement with the adjacent casing 74. The upper slip assembly 48 axially fixes the upper compression plate 44 of the stack.

In FIG. 6C and FIG. 5B, fluid pressure from surface, such as water, drives the piston 35 into the chamber 32, pressurizing the sealant 15A and rupturing the frangible disc 70 to dispense sealant out of the downhole end of the tool. Sealant encounters the casing plug 92 and flows up about the pleated rings 40 of the tool 12 and into the tool annulus 90. The stack 24 of rings has an uncompressed height of L0.

In the embodiment in which the sealant is hot asphaltic sealant, the sealant rises within the annular space, floods the stack and also transfers heat to the adjacent section of casing wall.

With reference to FIG. 6D, upward movement of the mandrel 38, actuated by pulling up on the tubing string 94 drives the lower compression plate 46 uphole, compressing the stack 24. The lower slip assembly 50 and compression plate 46, moving with the mandrel unit, compress the stack 24 sufficiently so as to cause the pleated rings 40 to partly flatten, expand radially, and press against the adjacent casing wall to effect a metal-to-metal circumferential compression and frictional engagement with the casing 74. The mandrel 38 is forcibly moved uphole through the fixed uphole slips 102.

Figure 6E:
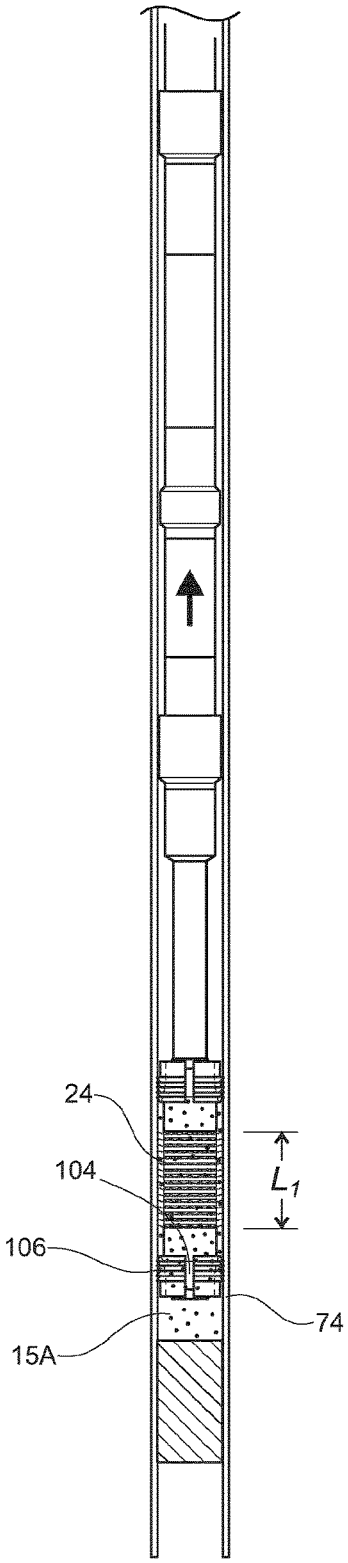

As shown in FIG. 6E, as the axial pull is increased, and the stack of 24 pleated rings 40 compresses to a axial threshold compression, frangible pins of the lower slip assembly shear allowing the mandrel 38 to move uphole a further increment so that the lower slip assembly 50 can ascend a lower cone or expander 104, and expand so that the lower slips 106 are biased into locking engagement with the casing 74. The stack of pleated rings is fixed in a compressed state with a stack height of L1.

Figure 6F:
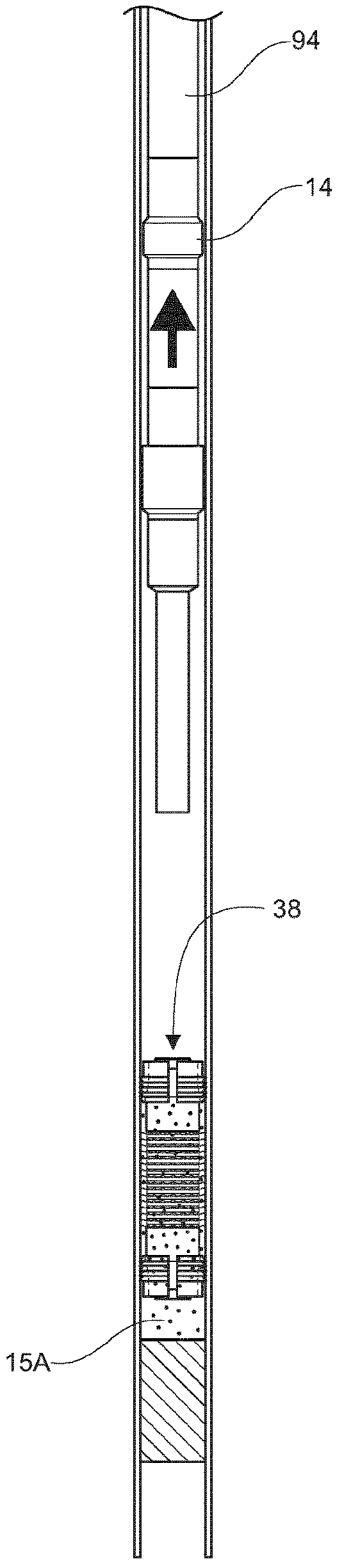
Figure 6G:
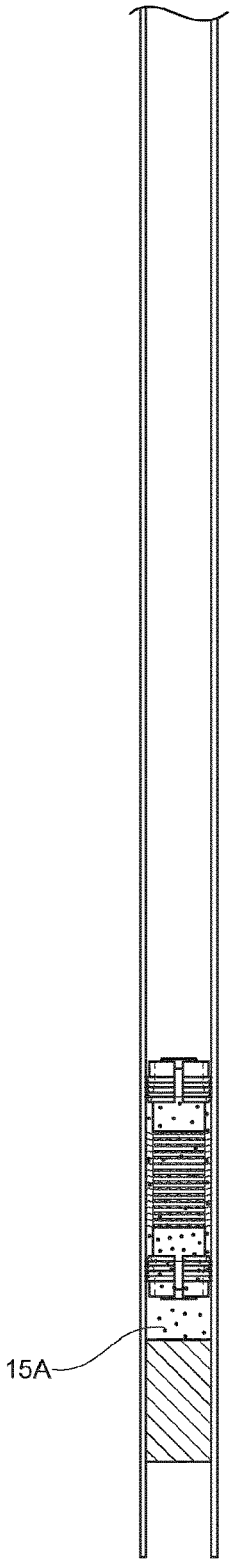

Later in the process, at FIGS. 6F and 6G, further pulling or rotation of the tubing/string mandrel unit causes a separation shear pin associated with the unit to part at FIG. 6F, allowing the container assembly 14 and tubing string 94 to separate from the mandrel 38 and be pulled out of hole. After the conveyance tubing string 94 is removed from the well, the tool 12 of compressed rings 40 and sealant 15A seal the casing in the abandoned well.

Figure 7A:
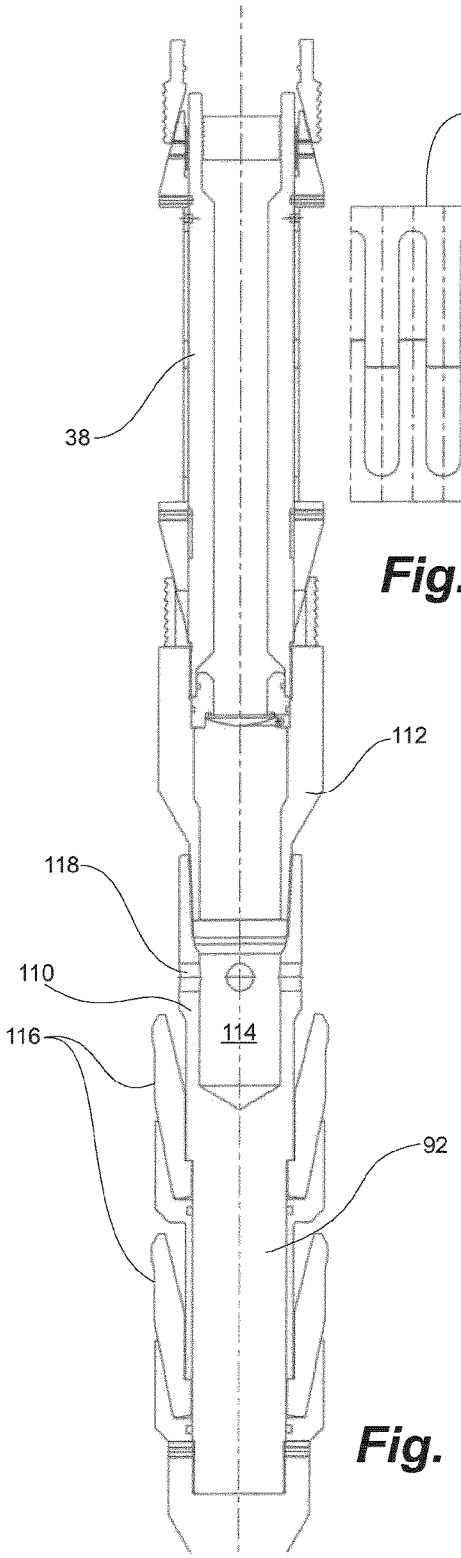
FIG. 7A is a side cross-sectional view of a tool fit with a packer cup casing plug below the stack of rings for effecting a well bore plug downhole of the tool, the pleated rings being omitted to illustrate an embodiment of a stack support sleeves.
Figure 7B:
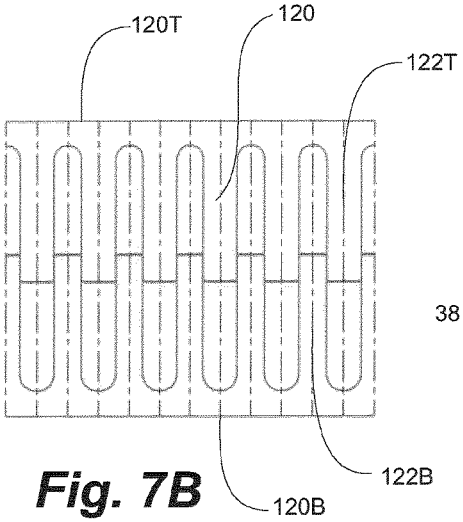
FIG. 7B is a rolled-out flat view of interlocking finger, stack-support sleeves about the mandrel.
Figure 8A:
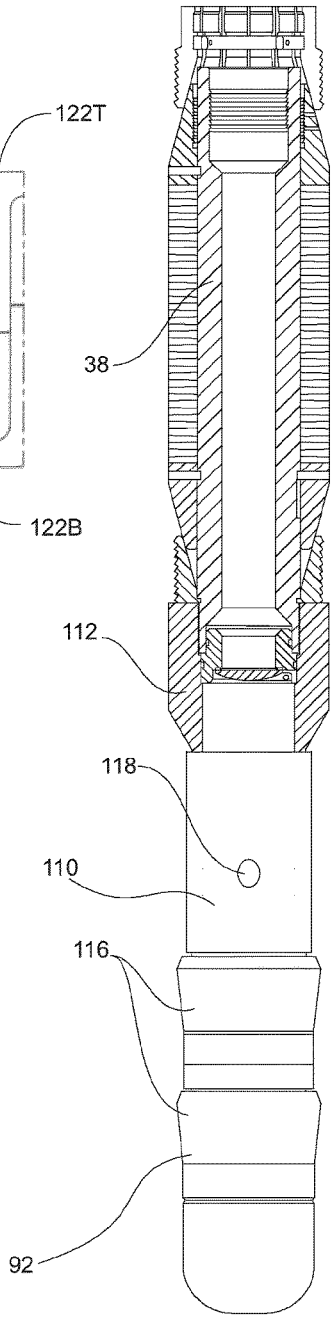
FIG. 8A is a side cross-sectional view of the tool and a side elevation view of a casing packer shoe below the stack of rings for effecting a casing plug downhole of the tool.

Turning more detail to the tool structure, and with reference to FIGS. 7A and 8A, the mandrel 38 can be fluidly connected to a casing plug 92. The casing plug 92 can be conveyed downhole with the tool 12 rather than relying on any pre-existing plug. The casing plug 92 can comprise a housing 110 connected to a downhole end 112 of the mandrel 38, the housing 110 having a plug bore 114, contiguous with that of the mandrel, and external packer cups 116 for sealing to the casing. The plug housing 110 has one or more ports 118 for fluid communication between the plug bore 114 and the tool annulus 90. In operation, the sealant is discharged through the bore of the mandrel, and through a one way flapper valve. The bore of the casing plug fills with sealant, which then overflows to the casing bore and uphole into stack of pleated rings and tool annulus. An alternate form of packer cup plug 92, such as a casing packer shoe, is illustrated on FIG. 8A in elevation view.

Once the sealant has been discharged, the flapper valve closes to prevent post-discharge backflow up the mandrel. The sealant sets and ensures the flapper valve is permanently sealed.

As shown in FIGS. 7A (with the rings omitted) and 7B, the mandrel 38 can be fit with a pair of sleeves 120 to add variability in mandrel diameter to accommodate various casing sizes. The sleeves can also aid in movement of the rings axially along the mandrel during compression. The pair of sleeves are fit with circumferentially-spaced interlocking fingers 122. The fingers of upper sleeve 122T are circumferentially and alternating interspersed with the fingers of lower sleeve 122B. The lower sleeve 122B can slide or shift uphole with the lower portion of the rings in the stack 24 as they are driven uphole along the mandrel 38.

Figures 8B, 9A, 9B, 9C:
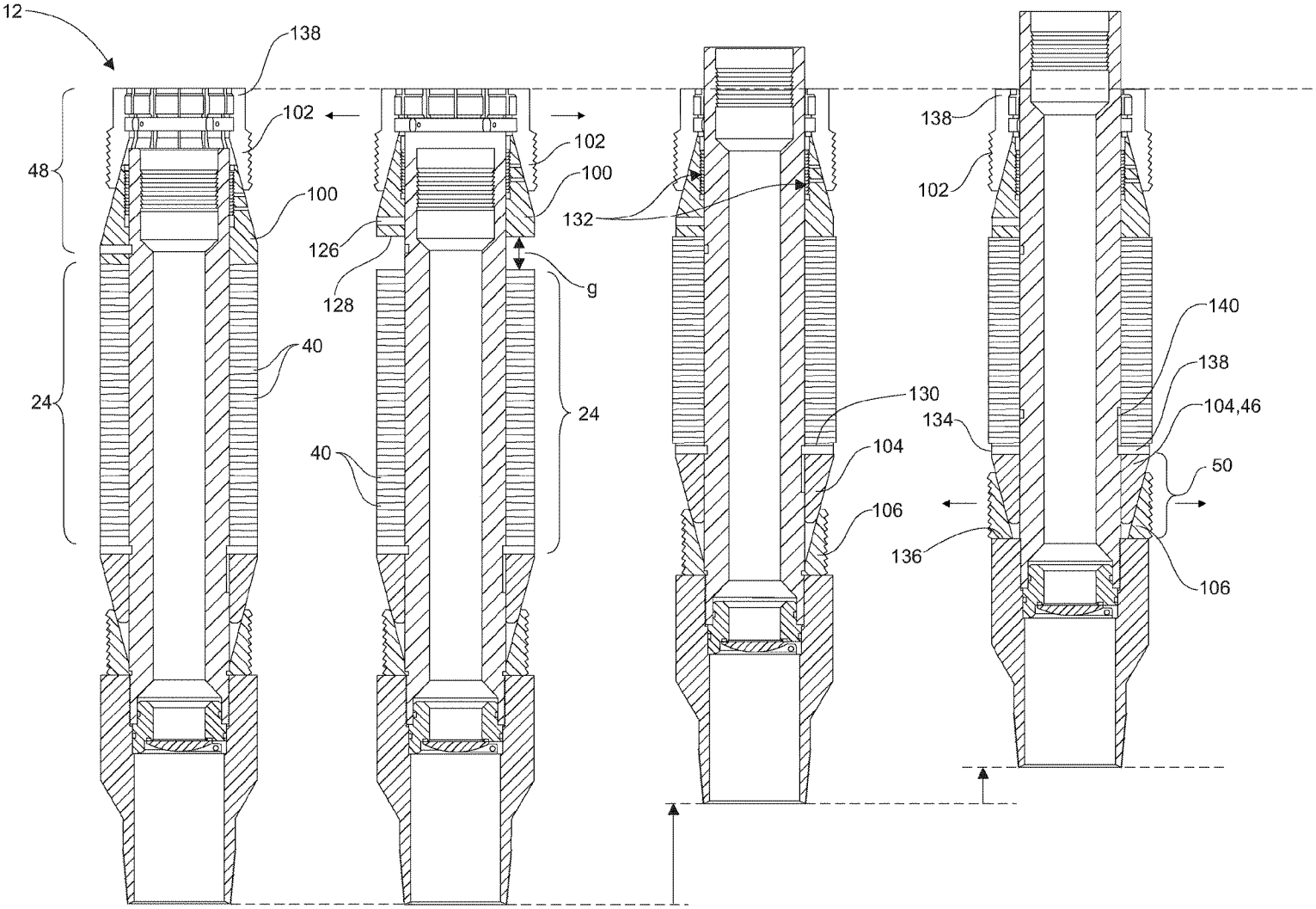
FIG. 8B, 9A through 9C are cross-sectional views of tool's stack of pleated rings of FIG. 8A, shown actuated in sequence, namely.

Turing to FIGS. 8B through 9C, illustrating the steps of fixing the tool 12 in the casing (NOT shown) and actuating the stack 24 of pleated rings 40, the tool is shown in four stages of operation, the sealant container assembly and casing plug omitted. With reference to FIG. 8B, the tool 12 is in run-in-mode, with the upper slip 102 disengaged and the expander cone 100 releasably secured to the mandrel 38. In FIG. 9A, the mandrel 38 is rotated, shearing the frangible pin 126, and the expander cone 100 is threadably-driven uphole, the cone's ramp engaging the slips 102 and driving them outwardly to engage the casing and fix the tool at the desired sealing location. Depending on any preload in the pleated rings 40, an axial gap g can open between the expander cone 100 and the stack 24. A downhole face 128 of the cone 100 also serves as the upper stop or compression plate 44 currently idle.

In FIG. 9B, the mandrel 38 is actuated to be pulled uphole. The lower expander cone 104 is releasably secured to the mandrel and follows the mandrel uphole. An uphole face 130 of the lower cone 104 also serves as the lower stop or lower compression plate 46 for the stack 24. As the mandrel 38 is pulled uphole, the lower compression plate 46 compresses the stack 24 of rings 40 against the upper compression plate 44, shortening the height of the stack 24 and expanding them radically outwards to the casing. The mandrel 38 drags through a ratcheting mandrel-to-expander interface 132, the components for which are shown in FIGS. 10A, 10B and 10C.

In FIG. 9C, when the resistance of the stack compression reaches a threshold, the force on the lower compression plate 46, the expander cone 104 in this embodiment, overwhelms a first lower frangible pin 134, and the mandrel is axially released therefrom. The mandrel drags the lower slips 106 uphole onto the expander 104. The slips 106 are axially secured to the mandrel and axially movable therewith, as illustrated, such as by engaging a sub box end 136 threaded to the downhole end of the mandrel. The lower slips 106 are forcibly driven axially uphole to engage the lower cone's ramp, driving them outwardly to engage the casing and fix the stack compression. A secondary lower frangible pin 138 is provided that can release the mandrel from the lower slip assembly 50 in its entirely in an emergency. So that the secondary lower pin 138 can survive the shearing of the first lower pin 134, the second pin is secured in a slot 140 in the mandrel to permit the mandrel axial movement to set the lower slips 106, but remain engaged with the mandrel 38.

Figure 10C:
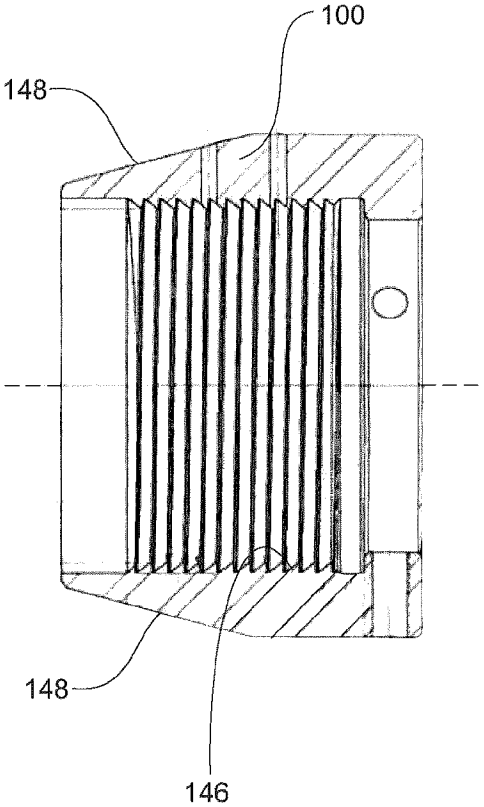
FIGS. 10A, 10B and 10C are the components of an upper slip shown in cross-section, the form of slips having a rotational actuation and a mandrel ratchet along the inner bore, more particularly, FIG. 10A illustrating the collet mounted, circumferentially arranged slips, FIG. 10B illustrating an axially split threaded ring, and FIG. 10C illustrating the conical expander, actuated axially by mandrel rotation of the threaded ring therein to engage the slips.
Figure 10B:
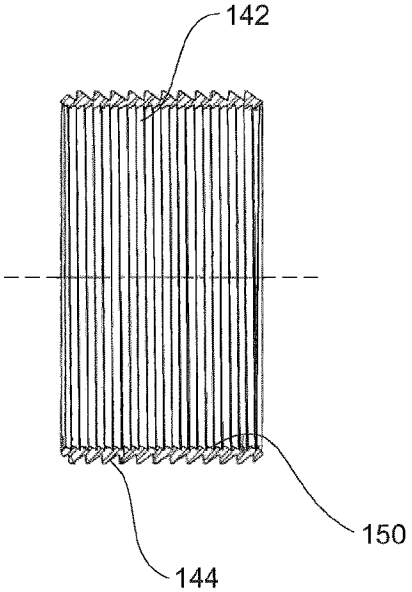
Figure 10A:
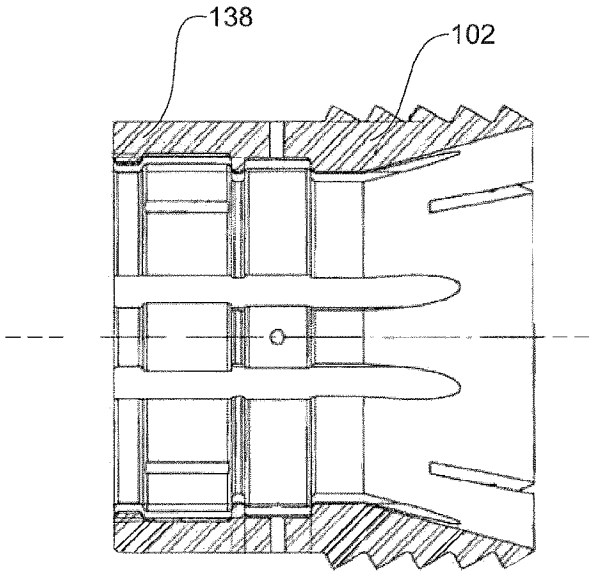

As discussed above, in the illustrated embodiment, and shown in FIGS. 10A, 10B and 10C, the upper slips 102 are actuated via threaded interface.

FIG. 10B illustrates an axially split threaded ring 142, and FIG. 10C illustrates the conical expander 100, actuated axially by mandrel rotation of the threaded ring 142 therein to engage the slips 102.

With reference to FIG. 10A, finger slips are collet mounted, circumferentially arranged slips that extend downhole from a ring base 138 and are supported on a tubular sub on or above the mandrel 38. The slips 102 can resist axial movement during actuation such as by conventional drag blocks, not shown. In FIG. 10B, the axially split, dual threaded sleeve 142 is provided between the expander 100 cone of FIG. 10C and the mandrel 38. An outer coarse-threaded portion 144 is threadably engaged with an internal thread 146 of the expander cone 100. Rotation of the expander cone 100 relative to the threaded sleeve 142 drives the cone ramps 148 uphole into the slips 102. The internal threads 150 are fine, asymmetrical threads that frictionally engage the mandrel. The mandrel need not be fit with complementary threads. The fine threads 150 have an uphole cant, also acting as a ratchet to enable a one-way uphole movement of the mandrel when actuated.

During actuation of the upper slip 102, rotation of the mandrel 38 rotates the threaded sleeve 142, and drives the expander cone 100 upwardly. The fine internal threads 150 of the sleeve may or may not rotate, but a reverse thread also enables uphole movement of the threaded sleeve, albeit at a slower rate due to the fine pitch. A rotation of about 6 turns can actuate the slips 102.

With reference to FIGS. 11A through 11F, in another embodiment, the casing 74 may have perforations therethrough to the annulus, or as illustrated, access to the annulus can be created. The sealing location for the tool can be aligned with existing perforations in the casing, perforations can be created, or the casing can be cut about all or a portion of its girth to access the casing annulus 162 thereout.

Figure 11A:
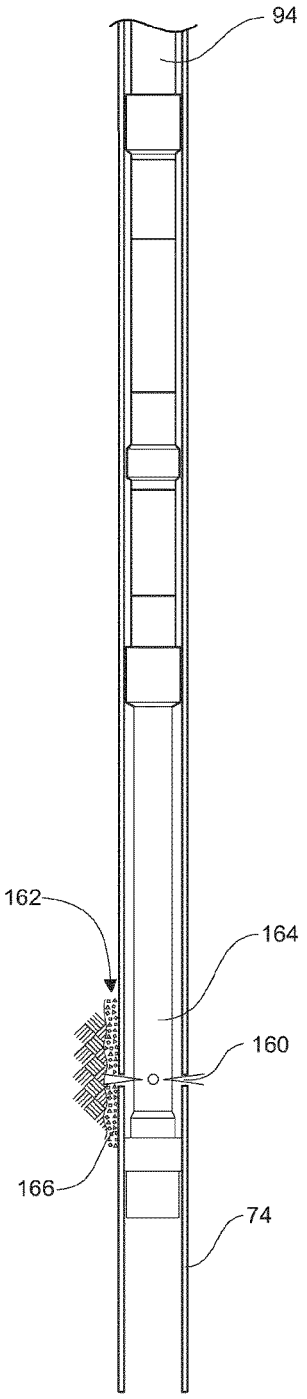
FIGS. 11A through 11F illustrate a cross-section of a well to be abandoned having a casing plug previously set therein and various steps of an alternated form of deployment and operation of the tool at casing cut above the casing plug, namely
Figure 11B:
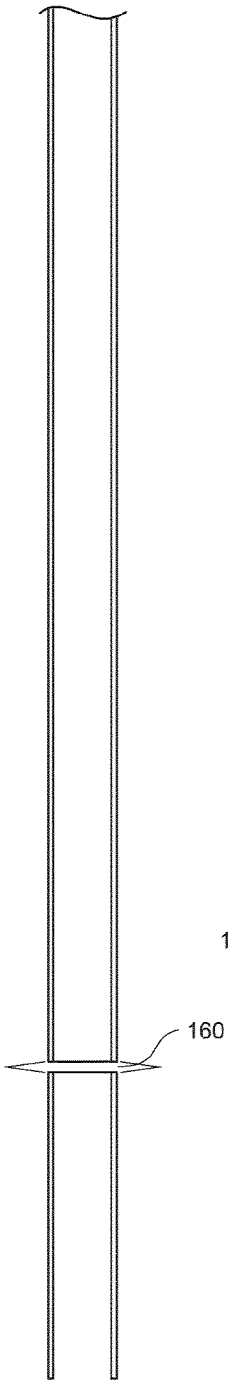

As shown in FIG. 11A, a cutting tool 164 can be run in to depth and the casing cut. As shown, an abrasive cutting tool can be run in on a conveyance string 94 to the sealing location. Fluid with abrasives therein can be jetted out towards the casing 74. In an embodiment, the cutting tool or the conveyance string 94 can be rotated to perforate or cut access ports 160 about a portion or the entirety of the casing about its girth at the sealing location. As shown in FIG. 11B, the cutting tool 164 is pulled out of hole, with the annulus 162 outside the casing accessed through the access ports 160.

Figure 11C:
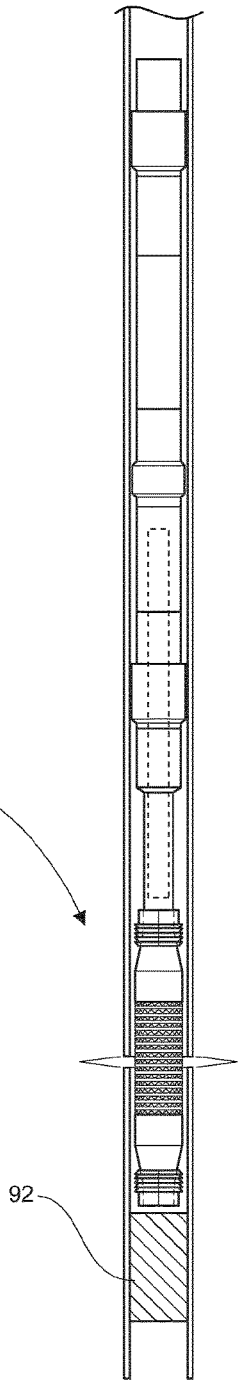
Figure 11D:
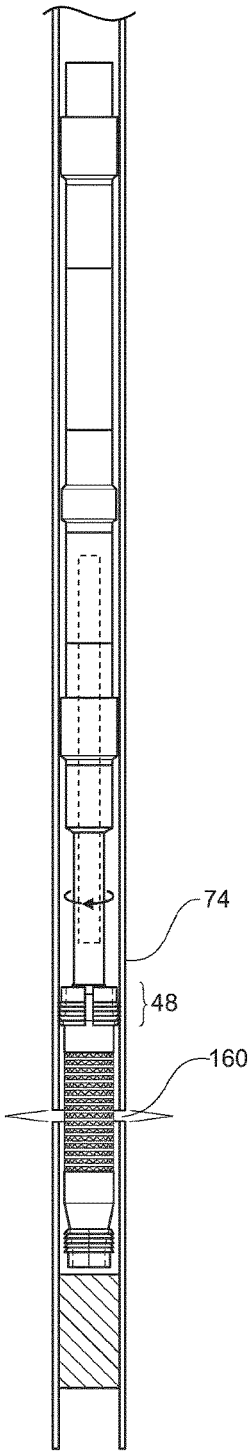
Figure 11E:
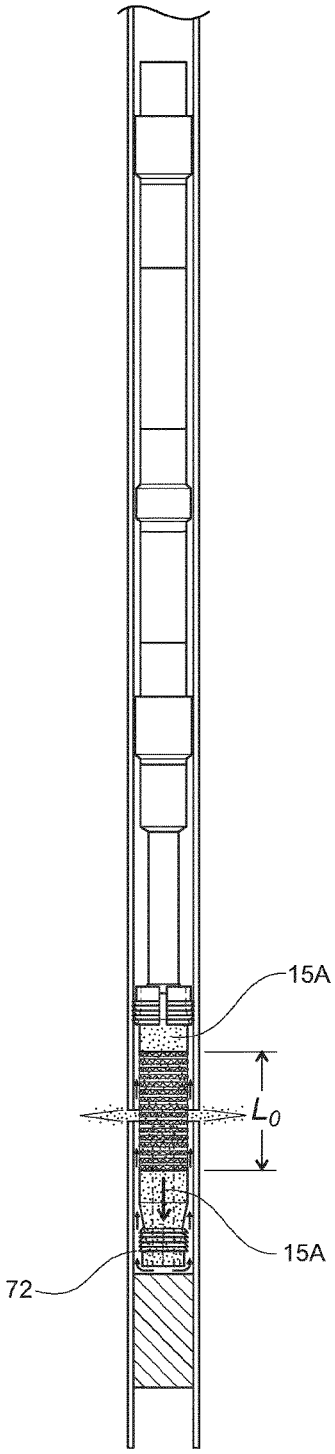

Turning to FIG. 11C, an embodiment of the current abandonment tool 10 can be run in to the sealing location. If a casing plug 92 was not already in place below the sealing location, the tool 12 could be fit with a casing plug shoe. At FIG. 11D, the upper locking assembly 48 of the tool is locked to casing 74 with the tool adjacent the cut, or straddling the cut or access ports 160 as shown. As shown in FIG. 11E, sealant 15A is discharged to the casing bore 72. The sealant is not only discharged about the tool annulus, but is also discharged through the access ports 160 formed in the casing and into the casing annulus.

Figure 11F:
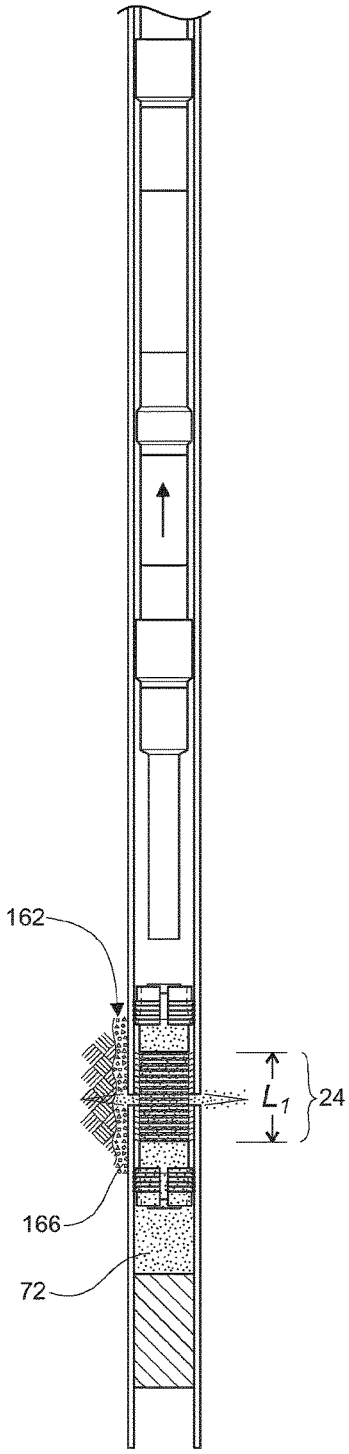

In FIG. 11F, the tool 12 is actuated and the stack 24 of pleated rings is compressed. Accordingly, as the casing annulus 162 is typically cement 166, the remediation of any fluid leak paths is two-fold: by mechanical expansion of the casing itself, and sealant flowing into and along any defects in the cement.

I claim:

1. A downhole tool conveyed into a casing of a well on a string of pipe extending downhole into the cased well from surface, comprising:

a tubular mandrel releasably connected to the string of pipe;

a stack of pleated rings slidably mounted on the mandrel;

a first compression plate slidably mounted on the mandrel at one end of the stack;

a second compression plate releasably mounted on the mandrel at the other end of the stack with the stack of pleated rings sandwiched therebetween;

a radially expandable first locking assembly releaseably slidable on the mandrel and adjacent the first compression plate, the first locking assembly selectively actuable to expand into locking engagement with the casing to thereby positionally fix the first compression plate and first end of the stack, the mandrel and second compression plate being axially movable relative to the first compression plate to compress the stack;

a radially expandable second locking assembly, releaseably secured to the mandrel adjacent the second compression plate for co-movement axially with the mandrel to forcibly compress the stack between the first and second compression plates for axially compressing the pleated rings and radially expanding the pleated rings into engagement with the casing; and frangible connection between the second locking assembly and the mandrel so that they move together until a resistive force by the compressed stack reaches a pre-determined extent, wherein the second locking assembly is released from the mandrel and is actuated to expand into locking engagement with the casing to thereby lock the compressed stack in compression.

2. The tool of claim 1 wherein the stack of pleated rings is radially expanded to close the bore of the casing at a sealing location in the well.

3. The tool of claim 1 wherein the mandrel has a bore in fluid communication with a bore of the well below the tool, and further comprising:

a container assembly connected between the pipe string and the mandrel having a chamber for storing sealant within, the chamber hydraulically coupled with the pipe string and in selectable fluid communication with a bore of the mandrel for displacing the sealant to the bore of the well.

4. The tool of claim 3 wherein chamber is a cylinder containing a piston movable therein, the piston closing the chamber at an uphole end and in fluid communication with the string of pipe wherein, when pressurized from the string of pipe, the piston displaces the sealant from the chamber.

5. The tool of claim 3 further comprising a casing plug downhole of the stack, wherein sealant is fluid blocked downhole thereof and urged into the pleated rings.

6. The tool of claim 5 wherein the casing plug is conveyed with the tool downhole into the well, the bore of the mandrel in fluid communication with the bore of the well uphole of the casing plug.

7. The tool of claim 1 wherein the stack of pleated rings further comprises:

a plurality of the pleated rings; and a plurality of flat washers, also slidably mounted on the mandrel, each flat washer axially separating a pair of adjacent pleated rings.

8. The tool of claim 7 wherein the stack of pleated rings further comprises a plurality of compressible spacers, each spacer sized to fit radially within a pleat of a pleated ring, wherein a plurality of spacers are fit to one or more pleats of a plurality of pleated rings in a population distribution that varies from a sparse concentration adjacent to the first compression plate, for providing a first resistance to compression, to a dense concentration adjacent to the second compression plate, for providing a second resistance to compression, the first resistance being less than the second resistance for providing an generally equal compression of the pleated rings along the axial extent of the stack.

9. The tool of claim 1 wherein the first locking assembly is a first slip assembly actuable to the lock the first compression plate to the casing, the slip actuable by rotation of the string of pipe.

10. The tool of claim 9 wherein the first slip assembly comprises a first expander cone having an uphole ramp and a downhole face against the stack forming the first compression plate, the first slip assembly comprising gripping elements cooperating with the first expander cone for radially driving the gripping elements into locking engagement with the casing upon the expander cone.

11. The tool of claim 9 wherein the first slip assembly is secured to the mandrel by a first frangible connection.

12. The tool of claim 11 wherein the second locking assembly is a second slip assembly secured to the mandrel by a second frangible connection, wherein the resistive force by the compressed stack is applied to the second slip assembly and when the resistive force reaches the predetermined extent the shear pins shear and actuate radially to lock the second slip and second compression plate to the casing.

13. The tool of claim 12 wherein the second slip assembly comprises a second expander cone having an downhole ramp and an uphole face forming the second compression plate, the second slip assembly comprising gripping elements cooperating with the first cone for radially driving the gripping elements into locking engagement with the casing upon the cone.

14. The tool of claim 12 wherein each of the first or second frangible connections are one or more shear pins.

15. The tool of claim 1 wherein:

the pleated rings are formed of steel; and the diameter of the uncompressed pleated rings are dimensioned so as to be insertable in the bore of the well casing and are expandable upon compression in the stack enough to engaged the casing wall.

16. A method for blocking fluid communication along a well at a sealing location, the well completed with casing, the method comprising:

conveying a tool having stack of pleated steel rings downhole to the sealing location in the casing and forming an annular space therebetween;

filling the stack and annular space with a charge of sealant; and then axially compressing the stack to expand the ring radially to engage the casing.

17. The method of claim 16 wherein the axially compressing the stack comprises:

locking a first compression plate at a first end of the stack to the casing; and actuating a second compression plate axially against at a second end of the stack to compress the stack against the first compression plate.

18. The method of claim 17 wherein locking of the first compression plate to the casing comprises locking a first slip to the casing.

19. The method of claim 18 wherein the axially compressing the stack further comprises:

after axially compressing the stack against the first compression plate, then locking the second compression plate to the casing at the second first end of the stack.

20. The method of claim 18 wherein the axially compressing the stack further comprises:

after axially compressing the stack against the first compression plate, then engaging a second slip for locking the second compression plate to the casing.

21. The method of claim 16 wherein the filling the stack and annular space with a charge of sealant comprises discharging a charge of heated asphalt to the tool annulus.

22. The method of claim 21 wherein discharging the heated asphalt comprises:

storing the charge of heated asphalt in a cylindrical chamber adjacent the tool; and applying pressure down a conveyance string of pipe from surface to actuate a piston to pressurize the charge and open a fluid passage to the tool annulus.

23. The method of claim 16 wherein the sealing location further comprises one or more access ports through the casing, the filling the stack and annular space with a charge of sealant further comprises discharging sealant to the tool annulus and through the one or more access ports.

24. The method of claim 23 further comprising, before conveying the tool downhole to the sealing location, forming the one or more access ports through the casing.

25. The method of claim 24 wherein forming the one or more access ports through the casing further comprises:

running in a cutting tool to the sealing location;

forming the one or more access ports; and pulling the cutting tool out of the well.

* * * * *